United States Patent [19]

Ullmo

[11] 4,347,663

[45] Sep. 7, 1982

[54] SAFETY RAZOR HAVING MOVABLE HEAD

[76] Inventor: Andre A. Ullmo, 3715 Warrensville Rd., Cleveland, Ohio 44122

[21] Appl. No.: 112,624

[22] Filed: Jan. 16, 1980

[51] Int. Cl.[3] ..... B26B 21/22; B26B 21/52

[52] U.S. Cl. ..... 30/47; 30/89

[58] Field of Search ..... 30/47, 57, 62, 64, 87, 30/89

[56] References Cited

U.S. PATENT DOCUMENTS

| | | | |
|---|---|---|---|
| 1,455,751 | 5/1923 | Hartman | 30/89 |
| 1,639,441 | 8/1927 | Spahr | 30/89 |
| 1,693,532 | 11/1928 | Stewart | 30/89 |
| 4,083,103 | 4/1978 | Estandian | 30/89 |
| 4,146,958 | 4/1979 | Chen et al. | 30/47 |
| 4,152,828 | 5/1979 | Lund | 30/89 |

*Primary Examiner*—Nicholas P. Godici

*Attorney, Agent, or Firm*—Porter & Associates Co.

[57] ABSTRACT

A safety razor having a movable head includes a handle to which a blade assembly carrier is secured. The blade assembly carrier is adapted to receive blade assemblies of different configurations as produced by different manufacturers; together, the blade assembly carrier and the blade assembly define the head of the razor. The head is movable about an axis parallel to edges of the blades. The head also is attached to the handle in such a fashion that the head "floats" with respect to the handle, that is, the head not only pivots about an axis parallel to the edges of the blades, but it also translates and is angularly displaceable relative to the handle. The resultant shaving action is superior to that attainable with other safety razors. Because of the simplicity of the components, the expense of the assembly is markedly reduced compared with prior safety razors having movable heads.

5 Claims, 7 Drawing Figures

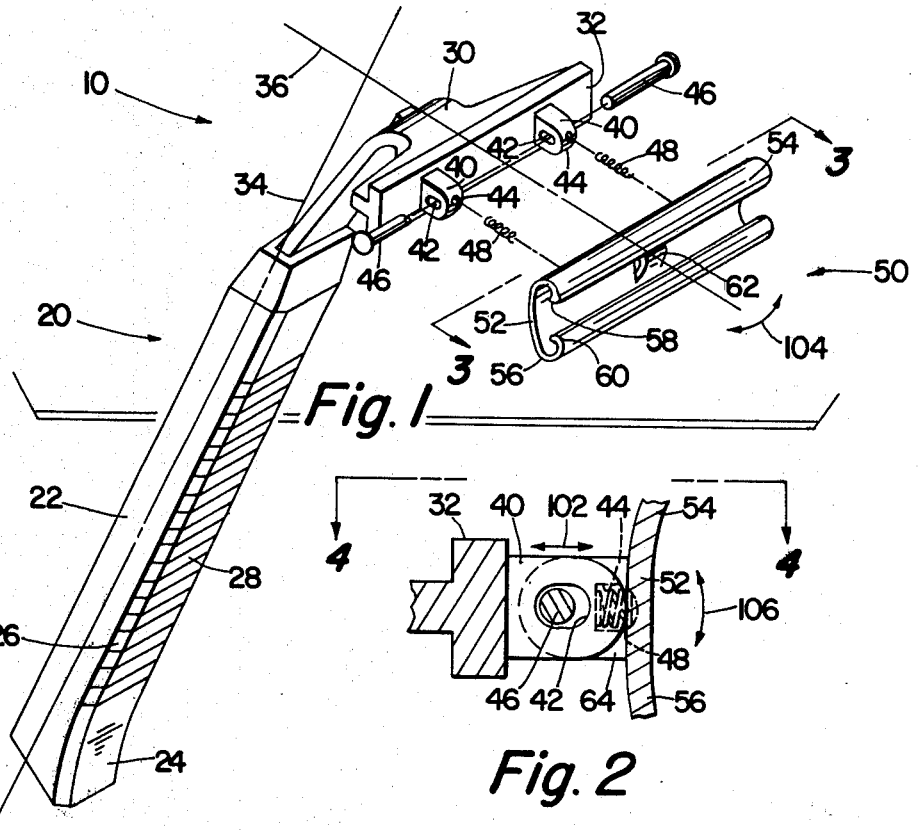
Fig. 1
Fig. 2
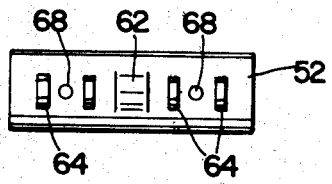
Fig. 3
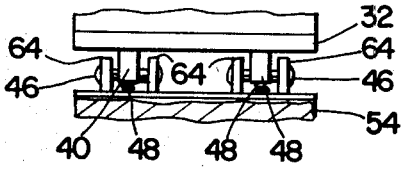
Fig. 4
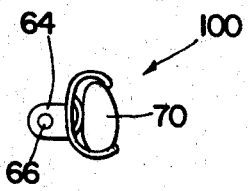
Fig. 5
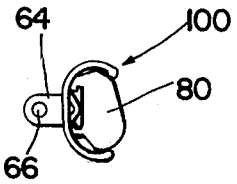
Fig. 6
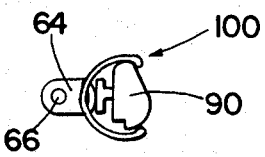
Fig. 7

SAFETY RAZOR HAVING MOVABLE HEAD

BACKGROUND OF THE INVENTION

The invention relates to safety razors and, more particularly, to a safety razor having a blade assembly carrier suitable for carrying differently configured blade assemblies and for permitting pivotal, translational, and yawing motion of the blade carrier with respect to a handle.

DESCRIPTION OF THE PRIOR ART

In many known safety razor system, a razor blade is sandwiched between a cap member and a guard member. The guard member, the cap member, and the razor blade are secured to a handle and fixed relative to one another. Razors of this general description have been used for many years, and certain of their drawbacks have lead to continuing developmental efforts.

One of the drawbacks of the aforementioned razor construction is that the cap member and the guard member must be separated in order for a used razor blade to be removed and replaced by a new one. Blade removal and replacement is difficult and time-consuming. In response to this consideration, injector razors and band razors have been developed. With an injector razor, a blade carrier assembly is engageable with the razor and, upon actuation of a pusher member, a used razor blade is ejected and a new razor blade is replaced. The replacement operation is very easy to carry out. In a band razor, a continuous cutting edge is contained in a supply reel and, upon rotation of a lever connected to a take-up reel, a new length of cutting edge is exposed. If anything, changing a shaving edge in a band razor is even easier than replacing a blade in an injector-type razor.

Another approach has been to produce a pre-assembled, disposable, easily replaceable blade assembly. In this type of blade assembly, one or more razor blade sections are clamped between upper and lower guard members. In safety razors of this type, a handle having a member engageable with the blade assembly is provided. When it is desired to change razor blades, an old blade assembly is removed from the handle and a new one is fitted to the handle. This particular approach to the problem of replacing razor blades has been particularly effective and popular. It also has been popular because multiple blade sections can be positioned closely parallel with each other for better shaving action.

Although inexpensive, pre-assembled, easily replaceable blade assemblies now exist, other drawbacks of safety razors still remain. One of these drawbacks relates to the quality of shave possible with such a system. A factor in shaving efficiency and effectiveness is the orientation of the blade or blades relative to the surface being shaved. Because a typical surface being shaved has undulations and inaccessible or awkward areas to reach, the shaving action is reduced in efficiency because an optimal relationship between the surface being shaved and the razor blades cannot be maintained. Razors having a fixed relationship between blade and handle call for considerable dexterity on the part of the user in order to produce acceptable results. Substantial changes in the disposition of the handle with respect to the surface being shaved must be accomplished and the difficulty of the shaving operation is made much more difficult than desired.

In an attempt to alleviate these difficulties, safety razors have been developed which attempt to more or less automatically maintain a desired relationship between a razor blade and a surface being shaved. One known safety razor causes a razor blade to reciprocate back and forth along an axis parallel to the edge of the razor blade during a shaving motion. Another safety razor provides limited pivotal movement of a razor blade about an axis substantially perpendicular to the surface being shaved. These devices have not been successful, probably because the type of motion provided for the razor blade did not properly orient the blade relative to the surface being shaved.

A more effective technique has been developed recently in which a razor blade assembly having multiple blade sections is pivotally mounted for rotation about an axis parallel with the edge of the razor blades. Even though this type of safety razor produces acceptable results, certain problems still remain. One of these problems is the expense of the entire assembly. Known devices are very complex and the resultant manufacturing and material expense unnecessarily increases the cost to the consumer of a given safety razor. Another drawback relates to the quality of the resultant shave. Pivotal movement of the blades about an axis parallel to the edges of the blades is a good approach to the problem, but additional, controlled motion of the blades relative to the handle should produce even better shaving efficiency and effectiveness.

SUMMARY OF THE INVENTION

The present invention relates to safety razors and more particularly, to a safety razor having improved qualities of manufacturing expense and shaving efficiency and effectiveness.

In accordance with the preferred practice of the present invention, a handle includes a blade assembly carrier mounted thereto. The blade assembly carrier assembly is configured such that it can readily accept preassembled, disposable razor blade assemblies produced in a variety of configurations. Taken together, the blade assembly carrier and the blade assembly define a head for the razor.

The blade assembly carrier in preferred form comprises an elongate, channel-like section formed from a single piece of material. Viewed from the end, the carrier is generally U-shaped and includes flexible sidewalls having inwardly turned edges; the sidewalls may be flexed apart to firmly clamp a blade assembly. A boss extends into the channel defined by the carrier to properly orient blade assemblies of different configurations.

The attachment between the head and the handle is an important feature of the invention contributing significantly to the effectiveness and inexpensiveness of the assembly. In essence, the attachment is a hinge having a lost motion connection. One of the members, for example the handle, includes a pair of outwardly directed tabs having laterally extending slots formed therein. The other member, in this instance the blade assembly carrier, includes spaced pairs of rearwardly extending ears having laterally extending openings formed therein. Springs are positioned intermediate the ends of the tabs and the back face of the carrier such that, upon alignment between the slots and the openings and upon the insertion of suitable fasteners such as rivets or screws, the head will be spring-biased with respect to the handle. Desirably, the fasteners are aligned along a common axis positioned parallel to the edges of the razor blades. Accordingly, the head can pivot about an axis parallel to the edges of the razor blades. The head always is returned to a neutral position by the springs, the degree to which pivoting of the head is resisted depending in part upon the strength of the springs. Translational motion and a yawing motion of sorts between the head and a longitudinal axis of the handle also is possible. The size of the fasteners, the length of the slots, the strength of the springs, and the spacing between the ears determine the degree to which the head can translate and yaw about the longitudinal axis of the handle.

As will be apparent from the foregoing summary, it is an object of the present invention to provide a new and improved safety razor.

It is yet another object of the invention to provide a new and improved safety razor having a blade assembly carrier suitable for expeditiously changing blade assemblies and for using blade assemblies of different configurations.

It is a further object of the invention to provide a new and improved safety razor having a blade assembly movable with respect to the handle, the nature and quality of movement providing superior shaving efficiency and effectiveness.

It is a still further object of the present invention to provide a new and improved safety razor having a blade assembly movable with respect to the handle about more than one axis, and particularly a blade assembly pivotal about both an axis parallel with the edge of the blade and about an axis generally parallel with the longitudinal axis of the handle.

It is yet a further object of the invention to provide a new and improved safety razor having a blade assembly movable with respect to the handle, the razor capable of being manufactured exceedingly rapidly and inexpensively.

These and other objects and a fuller understanding of the invention described in the present application may be had by referring to the detailed description and the claims, taken in conjunction with the accompanying drawings.

BRIEF DESCRIPTION OF THE DRAWINGS

FIG. 1 is an exploded, perspective view of a safety razor according to the invention, a blade assembly carrier being shown spaced from a handle;

FIG. 2 is a side view of a portion of an assembled safety razor according to the invention;

FIG. 3 is a view taken along line 3—3 of FIG. 1;

FIG. 4 is a plan view of a safety razor according to the invention showing the interconnection between the blade assembly carrier and the handle; and, FIGS. 5, 6 and 7 are side views of a portion of a safety razor according to the invention showing different blade assemblies positioned for use with the blade assembly carrier.

DESCRIPTION OF THE PREFERRED EMBODIMENT

In accordance with the preferred practice of the present invention, a safety razor 10 is shown in FIG. 1. The safety razor 10 includes a handle 20 to which a blade assembly carrier 50 is pivotally mounted. The blade assembly carrier 50 is usable with a number of differently configured blade assemblies 70, 80, 90 (FIGS. 5, 6 and 7) as will be described. Taken together, the blade assembly carrier 50 and any given blade assembly 70, 80, or 90 define a head 100 for the razor 10.

The handle 20 includes a grip portion 22 formed from a plastics material. The grip portion 22 includes a flared lower end region 24, beveled edges 26, and knurled surfaces 28. A metallic end portion 30 projects from the grip portion 22 a short distance and terminates in a rectangular face plate 32. The grip member 22 and the end portion 30 define a longitudinal axis for the safety razor 10. The longitudinal axis is indicated by the numeral 34 in FIG. 1. The surface of the face plate 32 lies in a plane generally parallel with the longitudinal axis 34. A line 36 taken perpendicular to the surface of the face plate 32 is nearly perpendicular with the longitudinal axis 34.

A pair of spaced tabs 40 project from the surface of the face plate 32. Each tab 40 includes a slot 42, the longer dimension of which is aligned generally parallel with the line 36. Each tab 40 includes an opening 44 extending into the end of the tab 40 a short distance. The openings 44 are sufficiently shallow that no communication between the openings 44 and the slots 42 exists. The slots 42 receive laterally extending fasteners in the form of rivets 46. The openings 44 receive springs 48.

The blade assembly carrier 50 is an elongate, U-shaped, channel-like structure having a flat bottom wall 52, and sidewalls 54, 56 having inwardly turned edges 58, 60. The blade assembly carrier 60 preferably is formed by an extrusion process using a plastics or metallic material. A boss 62, forming part of the bottom wall 52, projects into the channel defined by the walls 52, 54, 56 to provide support for a blade assembly, as will be described. The boss 62 preferably is formed by a stamping operation. The bottom wall 52 is substantially planar, and spaced pairs of ears 62 are secured to the wall 52 as by gluing to project from the back face of the wall 52. The ears 64 are generally the same size and shape as the tabs 40, except that the ears 64 contain aligned openings 66 having an inner diameter approximately equal to the outer diameter of the rivets 46. Individual ones of each pair of ears 64 are spaced slightly greater than the width of the tabs 40 to allow a loose fit between the tabs 62 and the ears 64. Indentations 68 are formed in the back face of the bottom wall 52 at a location intermediate individual ones of each pair of ears 64. The indentations 68 are of a size and shape suitable to receive the ends of the springs 48.

As best shown in FIGS. 2 and 4, the ears 64 engage the tabs 40 in a clevis-like relationship and the rivets 46 securely mount the blade assembly carrier 50 to the handle 20. In effect, the tabs 40, the ears 64, the slots 42, the springs 66, and the rivets 46 cooperate to create a hinge having a lost motion connection. Depending upon the strength and flexibility of the springs 48, the blade assembly carrier 50 will be spaced a small distance from the face plate 32. The carrier 50 always will tend to return to a neutral position defined by the rest position of the springs 48.

Referring now to FIGS. 5, 6 and 7, different preassembled, disposable blade assemblies 70, 80, 90 are shown as they might be used with the blade assembly carrier 50. In each case, the sidewalls 54, 56 are flexed and the inwardly turned edges 58, 60 hold the blade assembly in place. The boss 62 engages the back face of each blade assembly 70, 80, 90 and insures that the blade assembly is positioned properly with respect to the carrier 50. The flexible nature of the walls 54, 56, the configuration of the edges 58, 60 and the relationship of these components to the boss 62 is an important feature of the invention. A variety of differently configured blade assemblies can be gripped securely, and yet proper positioning of the blade assemblies is made possible. The edges of the razor blades (not shown) carried by the assemblies 70, 80, 90 are always effectively positioned parallel to the longitudinal axis of the carrier 50 and the face plate 32 and perpendicular to both the axis 34 and the axis 36.

After insertion of one of the blade assemblies 70, 80, 90, and during use of the safety razor 10, the head 100 will be urged toward the face plate 32 from time to time. If the force applied to the head 100 is great enough, the springs 48 will be compressed toward that position shown in FIG. 2, and the rivets 46 will move in the slots 42. The head 100 will be translated toward and away from the face plate 32 as indicated by the arrow 102 in FIG. 2. Angular displacement in the form of a yawing motion of the head 100 relative to the axis 34 also is permitted, because each end of the carrier 50 is separately supported by its own spring 48 and by the riveted interconnection between the tabs 40 and the ears 64. This yawing motion is indicated in FIG. 1 by the arrow 104. Due to the flexibility of the springs 48, the head 100 also can pivot about an axis defined by the rivets 46. This pivotal motion is indicated in FIG. 2 by the arrow 106.

As in other known safety razors having pivotal heads, the head 100 thus is pivotal about an axis substantially parallel with that of the edges of the blades carried by the carrier 50. By use of the present invention, a head movement consisting of pivotal motion, yawing motion, translational motion, or a combination of the three is made possible. In short, three-dimensional "floating" motion of the head relative to the handle is possible. This added versatility in head movement produces a safety razor having greater shaving efficiency and effectiveness than heretofore has been possible. Moreover, the configuration of the various components is such that they may be formed readily and inexpensively by extrusion and/or injection molding techniques. Accordingly, the expense of the completed safety razor 10 is far less than that of prior movable-head safety razors.

Although the invention can been described in its preferred form with a certain degree of particularity, it will be understood that the present disclosure of the preferred embodiment has been made only by way of example and that numerous changes in the details of construction and the combination and arrangement of parts may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. In a safety razor having a head for supporting at least one razor blade for use during a shaving operation, and a handle for permitting a user to conveniently guide the head during a shaving operation, the improvement comprising mounting means for attaching the head to the handle, the mounting means permitting movement of the head relative to the handle about more than one axis, the mounting means including:

(a) a hinge connecting the head and the handle, the hinge having a lost motion connection to permit translational, as well as pivotal, relative motion between the head and the handle, the hinge including:
  (i) spaced tabs projecting from a selected one of the handle or the head, the tabs having laterally extending slots; and,
  (ii) spaced pairs of ears protecting from the other of the selected members, the ears including aligned openings, the openings and the slots being alignable such that fastening members can pass through the openings; and, (b) a biasing means interposed between the head and the handle, the biasing means always urging the head toward a neutral, rest position.

2. In a safety razor having a head for supporting at least one razor blade for use during a shaving operation, and a handle for permitting a user to conveniently guide the head during a shaving operation, the improvement comprising mounting means for attaching the head to the handle, the mounting means permitting movement of the head relative to the handle about more than one axis, the mounting means including:

(a) spaced tabs projecting from a selected one of the handle or the head, the tabs having laterally extending slots;

(b) spaced pairs of ears projecting from the other of the selected members, the ears including aligned openings, the openings and the slots being alignable such that fastening members can pass through the openings, thereby permitting:
  (i) translational movement of the head toward and away from the handle;
  (ii) pivotal movement of the head about an axis defined by the fastening members; and,
  (iii) angular displacement of the head relative to the longitudinal axis of the handle; and, (c) a biasing means interposed between the head and the handle, the biasing means always urging the head toward a neutral, rest position.

3. The safety razor of claim 2, wherein the tabs project from the handle, the ears project from the head, and the biasing means is in the form of springs interposed between the head and the handle.

4. The safety razor of claim 3, wherein the tabs include openings into which the springs extend, and the head includes indentations engageable with the other end of the springs.

5. A safety razor capable of accepting blade assemblies of different configurations, comprising:

(a) a handle, the handle having an elongate gripping member defining a longitudinal axis, the handle also including a planar face plate, the surface of the face plate lying in a plane positioned generally parallel with the longitudinal axis of the handle, a pair of spaced tabs projecting perpendicularly from the surface of the face plate, the tabs having laterally extending slots with the longer dimension of the slots being positioned generally perpendicular to the surface of the face plate, the tabs each including a depression formed at or near the forwardmost portion of the tab; and, (b) a head secured to the handle, the head including a carrier having spaced pairs of rearwardly extending ears, the ears including aligned, laterally extending openings, the spacing between the ears being such that a clevis-like fit with the tabs is possible, fastening means extending through the openings and the slots in order to pivotally mount the carrier to the handle, a pair of springs disposed intermediate the depressions in the tabs and the carrier in order to constantly urge the carrier to a neutral, rest position with respect to the handle while at the same time permitting pivotal, translational, and yawing movement of the carrier, the carrier additionally including:

(i) an elongate bottom wall from which the ears extend on one side;

(ii) a pair of flexible elongate sidewalls secured to the bottom wall to define a generally U-shaped channel;

(iii) inwardly turned edges carried by the flexible sidewalls; the sidewalls and the inwardly turned edges adapted to grip blade assemblies of different configurations; and (iv) a boss included as part of the bottom wall, the boss projecting into the channel and adapted to engage blade assemblies in order to properly orient them with respect to the carrier.

* * * * *